US005386947A

United States Patent [19]

Omann

[11] Patent Number: 5,386,947

[45] Date of Patent: Feb. 7, 1995

[54] HAMMERMILL FOR REDUCED SHINGLES

[76] Inventor: James S. Omann, 11235 Park Dr., Rogers, Minn. 55374

[21] Appl. No.: 156,065

[22] Filed: Nov. 22, 1993

Related U.S. Application Data

[62] Division of Ser. No. 27,277, Mar. 5, 1993.

[51] Int. Cl.[6] ..... B02C 13/26; B02C 23/24

[52] U.S. Cl. ..... 241/41; 241/57; 241/73; 241/189.1

[58] Field of Search ..... 241/38, 41, 57, 62, 241/73, 188.1, 189.1, 189.2

[56] References Cited

U.S. PATENT DOCUMENTS

| | | | |
|---|---|---|---|
| 2,105,759 | 1/1938 | Stevenson | 241/41 |
| 2,141,662 | 12/1938 | Ossing et al. | 241/38 X |
| 2,217,118 | 10/1940 | Jesson et al. | 241/41 |
| 2,309,036 | 1/1943 | Beardsley | 241/41 |
| 2,394,760 | 2/1946 | Felton | 241/38 X |
| 3,011,220 | 12/1961 | Keller et al. | 241/41 X |
| 3,682,396 | 8/1972 | Whitney et al. | 241/41 |
| 3,887,141 | 6/1975 | Francis | 241/189.1 X |
| 4,222,851 | 9/1980 | Good, deceased et al. | 208/45 |
| 4,252,487 | 2/1981 | Jeppson | 404/77 |
| 4,269,693 | 5/1981 | Hastie | 208/39 |
| 4,319,856 | 3/1982 | Jeppson | 404/79 |
| 4,619,550 | 10/1986 | Jeppson | 404/80 |
| 4,706,893 | 11/1987 | Brock | 241/23 |
| 4,726,846 | 2/1988 | Jackson et al. | 106/281 R |
| 4,744,693 | 5/1988 | Smith | 404/77 |
| 4,756,484 | 7/1988 | Bechler et al. | 241/275 |
| 5,098,025 | 3/1992 | Drouin et al. | 241/21 |
| 5,236,497 | 8/1993 | Grzybowski | 106/282 |

FOREIGN PATENT DOCUMENTS

| | | | |
|---|---|---|---|
| 1599086 | 10/1990 | U.S.S.R. | 241/41 |

*Primary Examiner*—Timothy V. Eley
*Attorney, Agent, or Firm*—Palmatier, Sjoquist & Helget

[57] ABSTRACT

A method for reducing at production levels sticky, abrasive waste shingles and portions thereof into a reduced shingle material for use of a patch for potholes and cracks and as paving for roads and the like comprises shredding of the shingles to pieces, milling the pieces to particles and granules and impinging the particles and granules with intermittent blasts of compressed air to prevent clogging and sticking and to assist in discharging of the reduced shingle materials. The method may also include the step of spraying water upon the shingles and inside of the apparatus. The apparatus includes an improved hammermill with a compress air manifold with apertures therein for intermittently discharging compressed air which impinges upon the inner chamber of the hammermill and upon the pulverized waste materials. A pressurized water manifold with apertures may also spray the mill chamber of the hammermill with water to prevent clogging or sticking of the hammermill. A method is also provided for heating the reduced sticky, abrasive waste shingle granules for application as a patch as well as a paving for roadways, driveways, walkways and the like.

14 Claims, 5 Drawing Sheets

HAMMERMILL FOR REDUCED SHINGLES

This application is a divisional application of U.S. application Ser. No. 08/027,277, filed Mar. 5, 1993.

BACKGROUND OF THE INVENTION

This invention generally relates to the recycling and use of waste shingles, tar paper and portions thereof, and more specifically to an apparatus, method and use for reduced shingle materials as a patch for potholes and a paving for roads, drives, walkways and the like.

Methods and apparati for manufacturing asphalt paving compositions for roadways and the like are well known. Typically, virgin aggregate is heated and dried in a rotating drum and then mixed with liquid asphalt in a proportion typically of five to six percent asphalt by weight. The paving composition is then hauled with trucks to the job site and dumped into a paving vehicle. The paver lays the hot mix out level to a desired thickness on top of a graded gravel surface of a suitable elevation and smoothness. Thereafter the new pavement is compacted with a roller to the desired density.

Commercial asphalt paving composition plants have a variety of problems. Asphalt plants are complex in that they require scales, tumble dryers, conveyors, furnaces, mixers, huge tanks for heating oil and asphalt oil and complex pollution control systems for controlling dust and emissions. Consequently, asphalt plants are stationary and not easily movable.

Roofing materials, including shingles, tar paper and portions thereof, also utilize asphalt. The asphalt is commonly an asphalt-concrete oil (AC Oil) which is heavy and tar-like. FIG. 1 schematically shows in cross section the composition of shingles 10. Shingles 10 begin with a mat 12 which may either be fiberglass or of a paper felt-like material. Initially the mat 12 is soaked with a light saturine oil 14. Thereafter, a layer of asphalt-concrete oil 16 is applied thereto. Next a layer of lime dust 18 is placed or dusted thereon. Another layer of AC Oil 20 is applied afterwhich a rock layer 22 is applied. Thereafter, the entire composition is run through rollers.

Considerable waste is associated with the manufacture of new shingles, which may approximate one hundred million squares annually. A square is one hundred square feet of shingles. Each shingle has three tabs cut out. Each cutout tab measures one-quarter inch by five inches. The three discarded tabs represent approximately two and a half percent of each new shingle which is discarded. When old shingles and tar paper are removed from old construction, the one to three layers of shingles are all considered waste and are to be disposed of. Thus old shingle materials represent an even larger amount of waste associated with shingle materials.

Methods and apparati exist by which old shingles and shingle material can be recycled, such as those shown in U.S. Pat. Nos. 4,222,851; 4,706,893; and 4,726,846. The '893 patent shows a method and apparatus wherein recycled shingles may be used in an asphalt plant mixed with heated and dried aggregate and liquid asphalt to form an asphalt paving composition. However, this method and apparatus has not been commercially successful due to its inability to handle shingles without clogging or plugging up.

Shingle materials by their very nature pose a complex problem in their reduction for recycling. The shingle materials, including the rock and asphalt oil in a range of twenty to thirty percent, are extremely heavy, sticky and abrasive. Efforts to reduce the shingle materials to particles and granules in hammermills have met with the clogging, plugging and sticking of the particles and granules within the hammermill, shutting down the production and necessitating maintenance and cleaning. Consequently, no one has reduced shingle materials to a small enough size that will permit their use alone or within an asphalt plant.

There is a need for a portable apparatus and method for reducing shingles down to a granular level in mass quantities of several hundred tons per day. The granular shingle materials may then be heated to create a patch for potholes and cracks, as well as a paving for roadways, walkways, driveways and the like without the need for a complex and polluting asphalt plant.

BRIEF DESCRIPTION OF THE DRAWINGS

FIG. 5 is a top plan view of the shredder of FIG. 4 showing the oscillating cutter bars;

FIG. 12 is a side elevational view of the invention in combination with a paver.

SUMMARY OF THE INVENTION

Figures 1, 9, 10, 13:
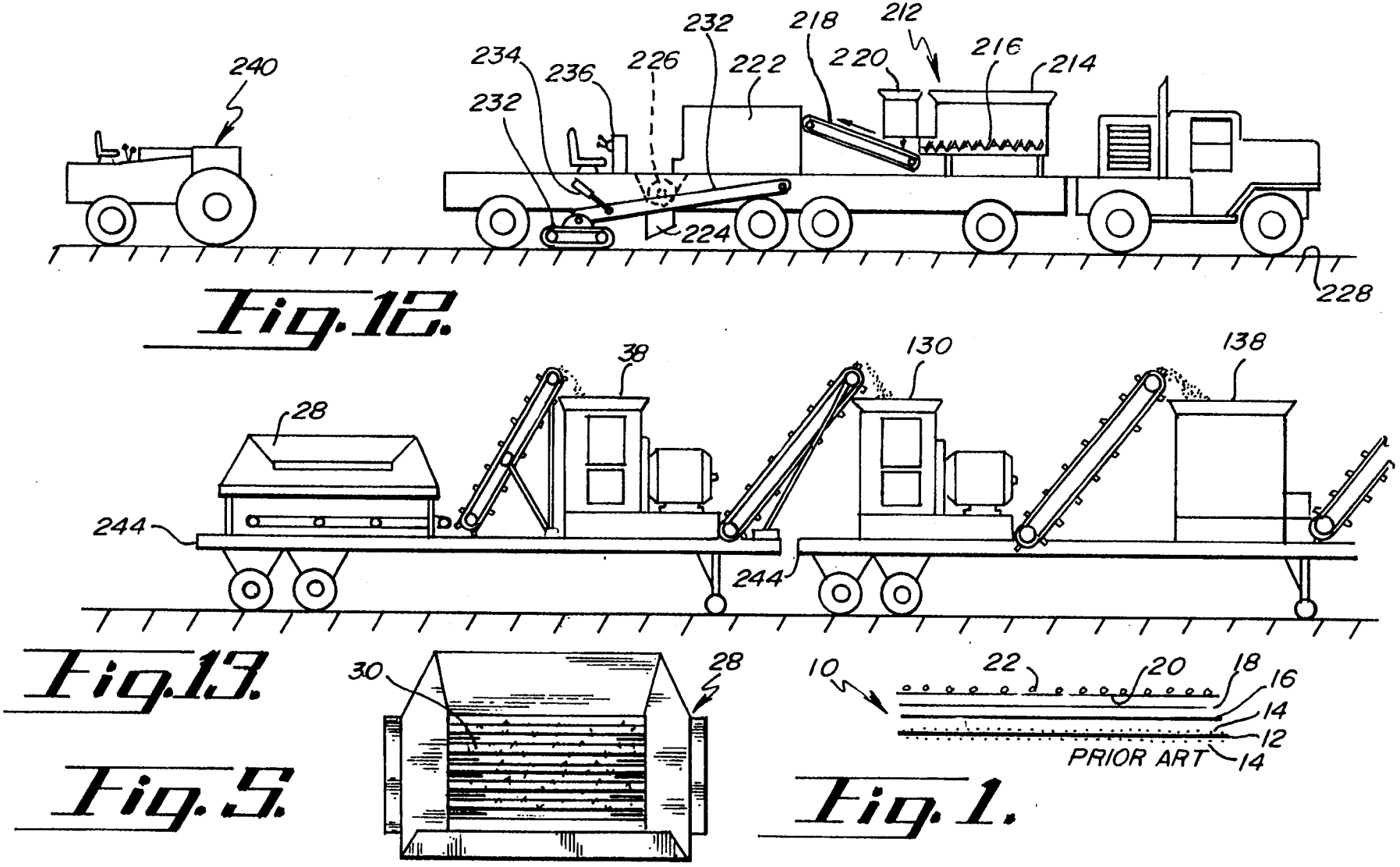
FIG. 1 is a prior art composition schematic of shingle materials.
FIG. 9 is a front elevational plan view of an alternative method and apparatus for heating the reduced shingle granules.
FIG. 10 is a cross sectional view taken along lines 10—10 of FIG. 9.
FIG. 13 is a side elevational view of the present invention mounted on trailers.

A method for reducing at production levels sticky, abrasive waste shingles and portions thereof into a reduced shingle material for use of a patch for potholes and cracks and as paving for roads and the like comprises shredding of the shingles to pieces, milling the pieces to particles and granules and impinging the particles and granules with intermittent blasts of compressed air to prevent clogging and sticking and to assist in discharging of the reduced shingle materials. The method may also include the step of spraying water upon the shingles and inside of the apparatus. The apparatus includes an improved hammermill with a compress air manifold with apertures therein for intermittently discharging compressed air which impinges upon the inner chamber of the hammermill and upon the pulverized waste materials. A pressurized water manifold with apertures may also spray the mill chamber of the hammermill with water to prevent clogging or sticking of the hammermill. A method is also provided for heating the reduced sticky, abrasive waste shingle granules for application as a patch as well as a paving for roadways, driveways, walkways and the like.

A principal object and advantage of the present invention is that it provides a method, apparatus and use for reduced shingle materials down to the granular level as heretofore not known for use as patching of cracks or potholes or paving for roadways, walkways, driveways and the like.

The present shingle material reduction apparatus is readily capable of processing two hundred tons of shingle material per day down to granules dimensionally described as a mixture of powder, granules on average of one-eighth inch, all of which are less than one-half inch.

Another object and advantage of the present invention is that the reduced granular shingle material may be packaged for safe consumer home use for heating in a conventional microwave oven. The packaged granular shingle material has a moisture content which makes heating in this manner relatively safe because the granular shingles will generally heat to two hundred degrees.

Another principal object and advantage is that the reduced shingle material of the present invention may be heated and used as surfacing for roads as well as jogging, walking and running trails and tracks and as a patch without the need of additional asphalt or oil and may be used immediately after creation.

Another object and advantage is that rejuvenator oil may be added to the reduced shingle material for softening without heat for use as a paving material.

Another object and advantage of the present invention is that it permits the further combination of other recycled granular materials such as glass or tires, to be added thereto for use in creating a patch material or road paving material without the necessity of additional oils alone or combined in a conventional asphalt plant.

Another object and advantage of the present method and apparatus is that it is significantly simpler than complex asphalt plants without the need for complex scales, tumble dryers, conveyors, furnaces, mixers, huge tanks for oils for both heating and asphalt oil and complex pollution control systems. The present apparatus is smaller and requires no additional oils making it substantially pollution free and readily transportable.

Another object and advantage of the present invention is that the granular shingle material, when used as paving or patchwork, is less susceptible to frost or icing caused by the insulation qualities of the fibers of the shingles, making the surface safer for vehicle and human use in cold conditions.

Another object and advantage of the present invention is that it utilizes shingle materials straight without the need for additional gravel or asphalt oils thereby completely eliminating dust pollution associated with asphalt plants.

Another object and advantage of the present invention is that it is simple and capable of sitting on a vehicle for easy transport and application of paving.

Another object and advantage of the present invention is that the apparatus provides for the reduction of shingle materials to granules that is free of clogging, plugging and capable of continuous production in the range of two hundred tons a day without shut down.

Another object and advantage is that the present invention creates road surfacing materials for patching of potholes and paving of roadways from readily available shingles without the need for additional oil, which is extremely cheap and which completely recycles existing waste materials without pollution.

Other objects and advantages will become apparent upon reading the following specification, claims and reviewing the appended drawings.

DETAILED SPECIFICATION

Referring to FIGS. 2 through 6B, the apparatus and method used for reducing shingle materials without the need of additional asphalt or the complexities of an asphalt plant may be seen. The discarded and waste shingles 24 heaped high in mountainous piles are loaded with a front end loader 26 into a material reduction apparatus 28 to create reduced shingle pieces 32. The shingle pieces 32 are then fed into the apparatus 36 comprising a first hammermill 38 and a second hammermill 130 together with the associated plumbing. The shredded shingle pieces 32 are reduced to shingle particles 120 and further into shingle granules 136.

FIGS. 7 through 11 show methods and apparati 146 for heating the reduced shingle granules 136 for use as a repair material or patch for potholes or as a paving for roadways. FIG. 12 shows a wheeled vehicle 212 adapted for carrying the reduced shingle granules 136, heating the granules and evenly applying the heated granules 136 to the road surface 228 afterwhich the new pavement may be compacted with a conventional roller 240. FIG. 13 shows the invention being mounted on transportable trailers 244.

Figures 2, 3, 4, 6:
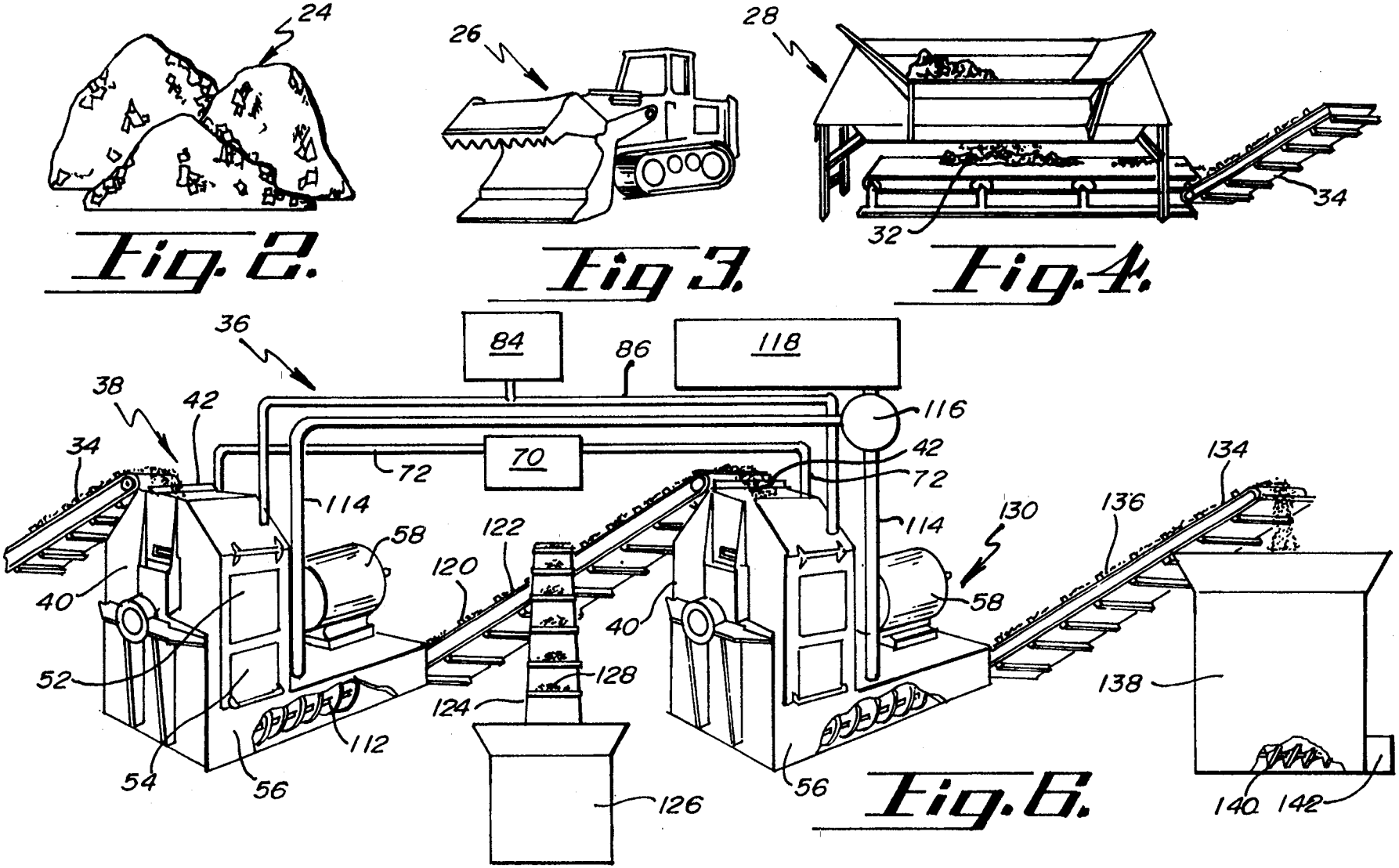
FIG. 2 is a front elevational view of a huge pile of waste and discarded shingle materials, tar paper and portions thereof.
FIG. 3 is a perspective view of a front end loader utilized in grasping and conveying the waste and discarded shingle materials.
FIG. 4 is a front elevational view of a material reduction apparatus or shredder with oscillating cutter bars utilized in reducing the shingle materials to pieces afterwhich the pieces fall upon a moving conveyor.
FIG. 6 is a side elevational view with schematics for the shingle reducing apparatus of the present invention.

Referring to FIGS. 4 and 5, the material reduction apparatus 28 may be seen. The apparatus 28 may also be referred to as a shredder with oscillating cutter bars 30 supporting knives. This shredding apparatus 28 is disclosed in co-pending allowed patent application Ser. No. 07/967,159 filed on Oct. 27, 1992 in the name of Applicant's brother, Lawrence F. Omann issued under U.S. Pat. No. 5,340,038 on Aug. 23, 1994. The material reduction or shredding apparatus 28 reduces the large pieces and rolls of discarded and waste shingles 10 which have become compacted and stuck together as they lay within the huge shingle pile 24. The apparatus 28 reduces the shingles to pieces of a size on average of two to eight inches. As the shingle pieces 32 fall through the shredder 28, they land on a conveyor 34 which carries the shingle pieces 32 to the apparatus 36 which reduces the shingle pieces 32 to particles 120 and later to granules 136.

Figure 6B:
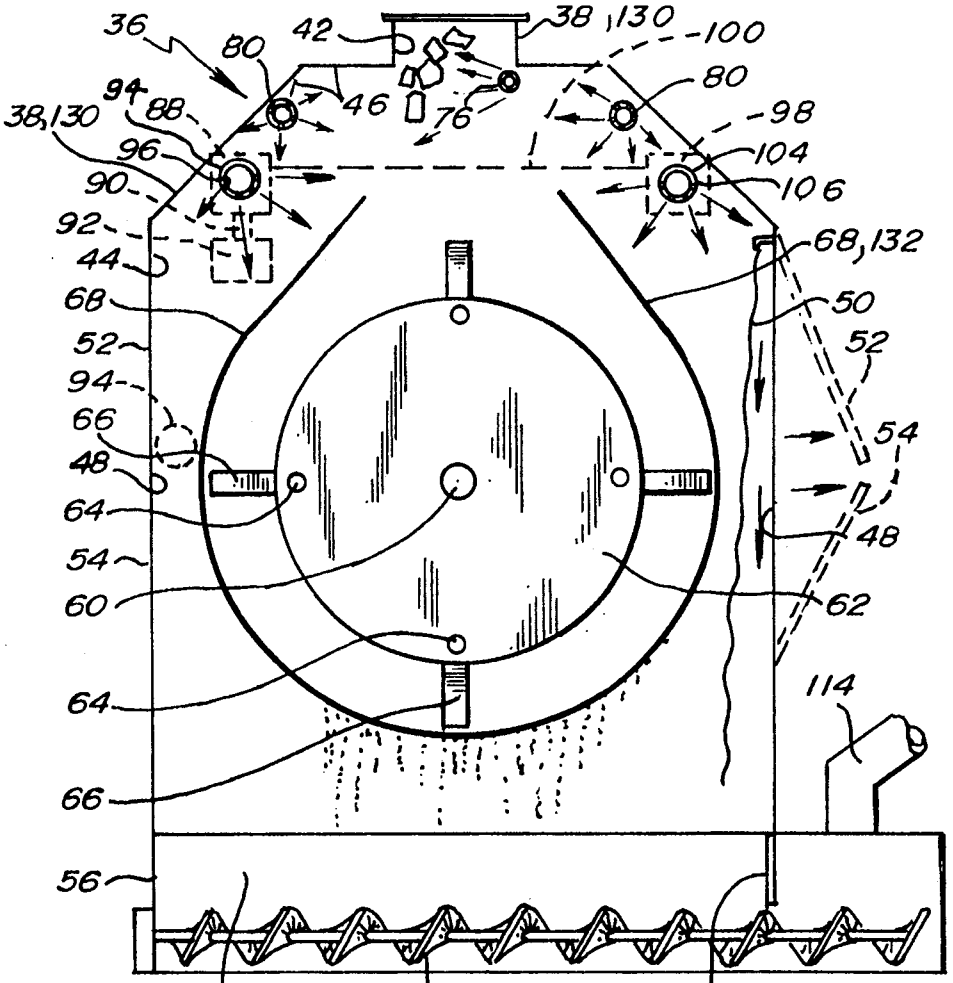
FIG. 6B is a cross-sectional view of the hammermill taken along lines 6B—6B of FIG. 6A.
Figure 6A:
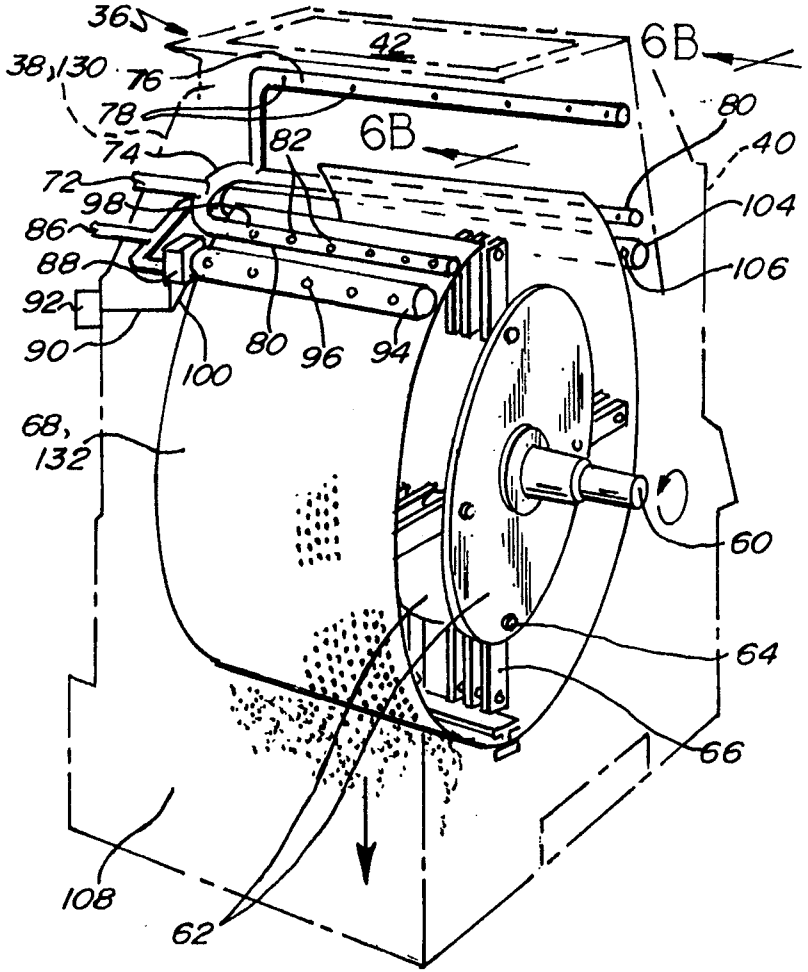
FIG. 6A is a perspective view of the mill chamber of the hammermill with the housing in phantom outline.

Referring to FIGS. 6, 6A and 6B, conveyor 34 leads to the first hammermill 38 which includes an upper housing 40 having a shingle flow inlet 42 for receiving the shingle pieces 32. Within the housing 40 is located a mill chamber 44 which has a ceiling 46 and an inner wall or walls 48. Optionally, a flexible fabric-like sheet 50 may be suspended along but spaced from the inner wall 48 as will be appreciated. Access into the mill chamber 44 is gained by the outward swinging of doors 52 and 54. The upper housing 40 is situated on a base 56 which appropriately supports a motor 58 which turns a shaft or rotor 60. A plurality of discs 62 are secured on to the rotor 60. The discs 62 are appropriately interconnected about their periphery by hammer pins 64 which support spaced apart reversible swinging hammers 66. About the discs 62 and hammers 66 spaced inwardly from the inner wall 48 is located a curved screen 68. The screen 68 in the first hammermill 38 appropriately may have apertures therethrough in the range of three to four inches illustratively.

A water source 70 is provided from which extends a water line 72 carrying twenty to thirty pounds per square inch of water. Naturally, the water is not used in extreme cold conditions. The water line 72 enters into the mill chamber 44 through upper housing 40 into a water manifold 74 which branches. Upwardly, is located a flow inlet water line 76 with nozzles or apertures 78 therein used for spraying the reduced shingle pieces 32 as they enter the first hammermill 38 to prevent sticking and to reduce or eliminate dust pollution. Mill chamber water lines 80 are generally located adjacent the ceiling 46 and inner walls 48 as they generally oppose each other and are located below and between the shingle flow inlet 42. The water lines 80 appropriately have nozzles 82 as to spray the mill chamber 44, ceiling 46, inner walls 48 and fabric sheet 50 (when used) with water as to discourage and reduce the sticking of shingle materials which otherwise may clog or plug the hammermill 38.

A compressed air source 84 is provided for supplying eighty to one hundred twenty pounds per square inch on average of compressed air. A compressed air line 86 extends from the source 84 to a first pulse valve 88 located suitably between the air line 86 and the compressed air manifold 94. The first pulse valve 88 may be of a diaphragm plug-type controlled by a solenoid. An electrical line 90 extends from valve 88 and is directed to a control box 92 which controls the first pulse valve 88 as to permit compressed air to intermittently enter the air manifold 94 every ten to fifteen seconds. The compressed air manifold appropriately may be approximately two inches and permits large volumes of compressed air to enter therein when the valve 88 is actuated. The manifold 94 has apertures 96 therein approximating one-half inch in diameter and in the range of six to thirteen apertures 96 in the manifold 94.

A second pulse valve 98 is also in line with compressed air line 86 at second compressed air manifold 104 and is controlled by electrical line 100 extending from control box 92. The second pulse valve 98 is similarly controlled as the first pulse valve 88, but to be actuated in an alternating fashion as to permit compressed air into the second compressed air manifold 104, which also has apertures 106 therein. The air manifolds 94 and 104 are substantially parallel to the rotor or shaft 60 and generally located adjacent the ceiling 46 and inner wall 48 as to discharge intermittently large amounts of compressed air which impinges on the mill chamber 44 surfaces, including the ceiling 46, inner wall 48, screen 68 and other components thereof. Additional manifolds 94 (shown in phantom outline) may be used within the mill chamber 44 and directed wherever the reduced shingle materials have a tendency to stick, clog or build up. Compressed air may also be directed between the inner wall 48 and the fabric-like sheet 50 on an alternating basis as shown by arrows. By this arrangement, the intermittent blast of compressed air shakes and ripples the fabric-like sheet 50 as to knock off any clinging or stuck reduced shingle materials which otherwise may cling to inner wall 48.

Below the mill chamber 44 is located a discharge chamber 108 which receives reduced shingle material particles 120 which have been pulverized by hammers 66 and pushed through screen 68. The discharge chamber 108 receives the reduced shingle material or particles 120 that are knocked off from the mill chamber ceiling 46, inner walls 48 and screen 68 by way of the intermittent compressed air blasts aided by the water. The discharge chamber 108 also suitably has a baffle 110 therein which assists in keeping the dust at low levels in extreme temperatures when water cannot be added to the hammermill 38. An auger 112 is suitably located in the base of discharge chamber 108 and draws the reduced shingle materials in the form of particles 120 from the hammermill 38. An exhaust duct 114 is appropriately located behind baffle 110 and appropriately has an in-line suction fan 116 in flow communication with a dust collector 118. The exhaust duct work 114 is appropriately actuated when water cannot be utilized as in cold weather and it is necessary to collect the dust and soot created by the hammermill 38 to prohibit pollution.

Shingle particles 120 exiting the first hammermill 38 are generally on average in a range between one-eighth inch to four inches. The particles 120 are drawn by auger 112 onto the second conveyor 122 which is then suitably fed into a second hammermill 130 for reducing the shingle particles 120 to granular shingle material 136 wherein sixty to eighty percent of the end product is powder and granules less than one-half inch in diameter and averaging one-eighth inch but no more than approximately one inch. A gradation test of the granular shingle material 136 produced the following summary:

| Sieve gradation | % of Shingle Granules 136 Passing |
|---|---|
| .375 | 100 |
| .187 (#4) | 74 |
| .0787 (#10) | 72 |
| .0331 (#20) | 51 |
| .0165 (#40) | 40 |
| .0070 (#80) | 28 |
| .0029 (#200) | 25 |

Optionally, a third conveyor 124 may lead from a storage bin 126 which appropriately holds shredded tires, glass, gravel, sand, plastic or other shredded or granulated material 128 for addition onto the second conveyor to be mixed with the shingle particles 120 in the second hammermill 130. It has been found that there is adequate oil content within the shingles 10 as to permit the addition of these recyclable materials for use in patch or road paving.

The second hammermill 130 is essentially the same as the first hammermill 38 with one exception. That is, the three to four inch screen 68 is replaced in the second hammermill 130 with a screen 132 which has apertures therein in a range on average between seven-sixteenths and three-quarters of an inch. The exact aperture size of screens 68 and 132 are directly dependant upon the ambient air temperature and the speed of the rotor 60, discs 62 and hammers 66 which are generally in a range of twelve hundred to eighteen hundred r.p.m. Higher r.p.m.'s mean the screens may be of a larger diameter while the hammermill has better wear at lower r.p.m.'s.

Figure 7:
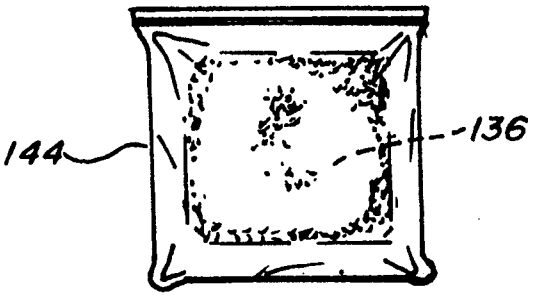
FIG. 7 is a front elevational view of reduced shingle materials packaged in a zip-lock type plastic bag.
Figure 9:
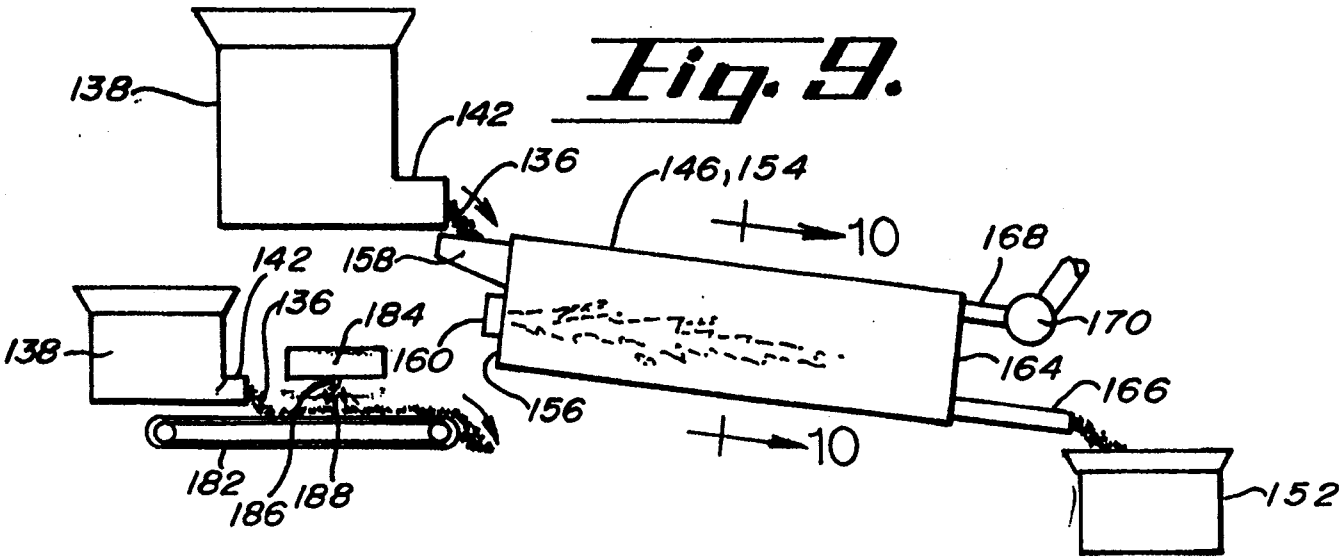

The reduced granular material 136 is placed upon a third conveyor 134 from the second hammermill 130 and fed into a storage or surge bin 138 which appropriately may have an auger 148 in its base leading to a discharge outlet 142. The shingle granules 136 may be bagged or packaged suitably in zip-lock like bags as shown in FIG. 7 for home use in patching cracks or potholes in walkways, driveways and the like.

Testing has revealed that packaged granular shingle material 136 in plastic bags, paper bags with or without an inner layer or stain inhibitor film (popcorn bags), more rigid plastic containers or the like 144 will permit the consumer to heat relatively small amounts in a home microwave. For instance, three pounds of the granular material 136 may be heated in a fifteen hundred watt microwave for four to six minutes up to a temperature on average of two hundred degrees. Thereafter the sticky and soft granular shingle material 136 may be applied to cracks or potholes. A three pound package will do approximately a six inch square of approximately one and one-half inch compacted thickness.

Figure 8:
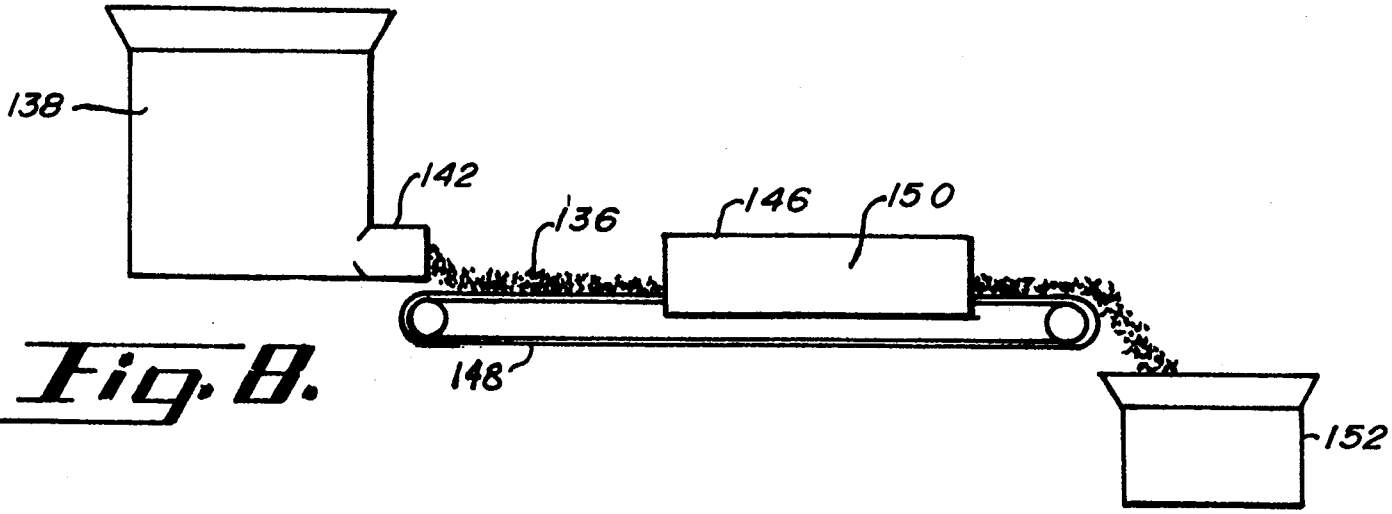
FIG. 8 a front elevational plan view of a method and apparatus for heating the reduced shingle granules.
Figure 10:
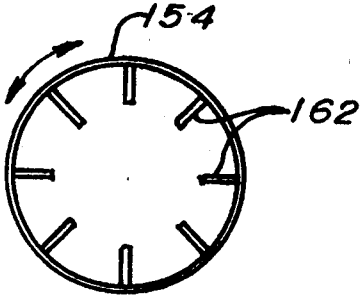

Referring to FIG. 8, the larger scale or commercial application of heating the shingle granules 136 may be appreciated. Granules 136 are discharged from outlet 142 of storage bin 138 onto a conveyor belt 148 which passes through a microwave oven 150. Thereafter, the heated shingle granules 136 may be dumped into a hot storage bin 152 for use or transport to the location for use. Tests have revealed that a fifteen hundred watt microwave will heat approximately one pound of granules 136 to 250° F. in one and a half minutes.

Referring to FIG. 9, an alternative heating means for the shingle granules 136 is revealed. The granules 136 are again discharged from storage bin 138 into a tilted rotating cylindrical heater drum 154 having an open front 156 and a material receiving trough 158. A burner supplying hot air 160 is directed inwardly at the open front 156. As seen in FIG. 10, fins 162 are located within the drum 154 which aid in the tumbling and tossing of the shingle granules 136 during heating. The drum 154 has an open rear 164 and a dump shoot 166 for dumping the heated granules 136 into a hot storage bin 152. Again, an exhaust duct 168 having an in-line fan 170 may be utilized to reduce and prevent pollution to the ambient air or atmosphere by directing the exhaust to dust collector or scrubber 118.

Figure 11:
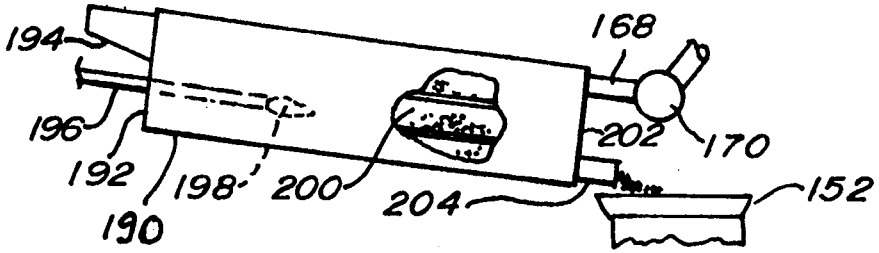
FIG. 11 is a front elevational plan view partially broken away of yet another alternative method and apparatus for softening the shingle granules.

Referring to FIG. 11, another alternative embodiment of heating the shingle granules 136 may be appreciated. The granules 136 are discharged from storage bin 138 onto a conveyor 182 above which is located a fuel source 184 having nozzles 186 therein. Fuel 188, such as gasoline, kerosine or fuel oil, is discharged from nozzles 186 onto the granules 136 and then dumped into a tilted, rotating cylindrical ignitor drum 190 having an open front 192 and a receiving trough 194. An ignitor 196 with a pilot 198 extends through the open front 192 into the rotating ignitor drum for igniting the fuel 188 and heating the granules 136. Fins 200 are also utilized in the ignitor drum 190 for mixing purposes. The drum 190 has an open rear 202 with a dump shoot 204 leading into a hot storage bin 152. The exhaust duct 168, fan 170 and collector scrubber 118 arrangement may also be used with this arrangement. Tests have revealed that five hundred pounds or one-quarter ton of granules would require approximately one gallon of fuel for this method of heating.

The shingle granules 136 may be softened through for paving with the addition of a rejuvenator oil, gasoline, kerosine or fuel oil and tumbled in a rotating drum 154 or 190. After paving, the new pavement should be unused for a while to permit curing and evaporation of the rejuvenator oil.

Referring to FIG. 12, a wheeled vehicle 212 may be seen which may be used as a paver for applying the heated granules 136. Vehicle 212 appropriately has a granular shingle material storage bin 214 with an auger 216 in its base. Auger 216 draws the granules 136 onto inclined conveyor 218 afterwhich the granules 136 optionally may be sprayed with fuel 220 depending on the appropriate heating means 222 as previously disclosed. The heated granules are then dumped into a trough 224 having an auger 226 for spreading the granules 136 in heated condition evenly upon roadway 228. Drag arms 230 extend backwards having a screed 232 at their ends with cylinders 234 adjustable for adjusting the pressure of screed 232. The control of the paving on vehicle 212 may be handled at a control center 236. After application, a conventional roller 240 may optionally compact the new pavement afterwhich it may immediately be driven upon or used by the public.

FIG. 13 illustrates the mounting of the shredder 28, first and second hammermills 38 and 130 and storage bin 138 on trailers 244 for transportation to the site for operation.

The present invention may be embodied in other specific forms without departing from the spirit of essential attributes thereof; therefore, the illustrated embodiment should be considered in all respects as illustrative and not restrictive, reference being made to the appended claims rather than to the foregoing description to indicate the scope of the invention.

I claim:

1. An improved hammermill for reducing at production levels sticky waste materials, comprising:

(a) a housing with a materials flow inlet into a mill chamber having a ceiling and an inner wall;

(b) a curved screen spaced inward from the inner wall and in flow communication with the materials flow inlet;

(c) a plurality of rotatable coaxial discs spaced inward from the curved screen pivotally supporting between their peripheries spaced hammers which pulverize the waste materials and force the pulverized waste material through the screen;

(d) a discharge chamber below the screen to receive the pulverized waste materials from which it is removed from the hammermill; and (e) a compressed air manifold with apertures therein within the mill chamber for intermittently discharging compressed air which impinges upon the inner wall and screen to dislodge and knock off sticky, pulverized waste materials clinging to the inner wall and screen to avoid sticking, clogging and plugging of the sticky, pulverized waste materials within the hammermill and to assist the sticky, pulverized waste materials in discharging from the hammermill.

2. The improved hammermill of claim 1, wherein the compressed air manifold is adjacent the ceiling and inner wall.

3. The improved hammermill of claim 1, wherein the compressed air manifold is adjacent the inner wall.

4. The improved hammermill of claim 1, wherein the compressed air manifold is substantially parallel to the axis of the discs.

5. The improved hammermill of claim 1, further comprising a second compressed air manifold with apertures therein adjacent the ceiling and the inner wall within the mill chamber opposing the first air manifold with the flow inlet therebetween.

6. The improved hammermill of claim 1, further comprising a flexible fabric-like sheet spaced from and hanging downwardly along the inner wall, the sheet to receive discharging compressed air between the sheet and the inner wall as to shake and ripple the sheet to knock off sticky, pulverized waste materials clinging to the sheet.

7. The improved hammermill of claim 1, further comprising a pressurized water manifold with apertures therein adjacent the material flow inlet to spray the sticky waste materials with water as the materials enter the mill chamber.

8. The improved hammermill of claim 1, further comprising a pressurized water manifold with apertures therein adjacent the ceiling and the inner wall within the mill chamber for spraying the mill chamber, wall, screen, discs and hammers with water to prevent the sticky, pulverized waste materials from adhering thereto.

9. An improved hammermill for reducing at production levels sticky waste materials, comprising:

(a) a housing with a materials flow inlet into a mill chamber having a ceiling and an inner wall;

(b) a curved screen spaced inward from the inner wall and in flow communication with the materials flow inlet;

(c) a plurality of rotatable coaxial discs spaced inward from the curved screen pivotally supporting between their peripheries spaced hammers which pulverize the waste materials and force the pulverized waste material through the screen;

(d) a discharge chamber below the screen to receive the pulverized waste materials from which it is removed from the hammermill; and (e) a compressed air manifold with apertures therein within the mill chamber and substantially parallel to the axis of the discs for intermittently discharging compressed air which impinges upon the inner wall and screen to dislodge sticky, pulverized waste materials to avoid sticking, clogging and plugging of the sticky, pulverized waste materials within the hammermill and to assist the sticky, pulverized waste materials in discharging from the hammermill.

10. The improved hammermill of claim 9, further comprising a second compressed air manifold with apertures therein adjacent the ceiling and the inner wall within the mill chamber opposing the first air manifold with the flow inlet therebetween.

11. The improved hammermill of claim 9, further comprising a flexible fabric-like sheet spaced from and hanging downwardly along the inner wall, the sheet to receive discharging compressed air between the sheet and the inner wall as to shake and ripple the sheet to knock off sticky, pulverized waste materials clinging to the sheet.

12. The improved hammermill of claim 9, further comprising a pressurized water manifold with apertures therein adjacent the material flow inlet to spray the sticky waste materials with water as the materials enter the mill chamber.

13. The improved hammermill of claim 9, further comprising a pressurized water manifold with apertures therein adjacent the ceiling and the inner wall within the mill chamber for spraying the mill chamber, wall, screen, discs and hammers with water to prevent the sticky, pulverized waste materials from adhering thereto.

14. An improved hammermill for reducing at production levels sticky waste materials, such as petroleum based shingles and tar paper, comprising:

(a) a housing with a materials flow inlet into a mill chamber having a ceiling and an inner wall;

(b) a curved screen spaced inward from the inner wall and in flow communication with the materials flow inlet;

(c) a plurality of rotatable coaxial discs spaced inward from the curved screen pivotally supporting between their peripheries spaced hammers which pulverize the waste materials and force the pulverized waste material through the screen;

(d) a discharge chamber below the screen to receive the pulverized waste materials from which it is removed from the hammermill; and (e) a pair of compressed air manifolds with apertures therein opposing each other between the flow inlet and adjacent the ceiling and inner wall within the mill chamber for intermittently discharging compressed air which impinges upon the inner wall and screen to dislodge sticky, pulverized waste materials to avoid sticking, clogging and plugging of the sticky, pulverized waste materials within the hammermill and to assist the sticky, pulverized waste materials in discharging from the hammermill.

* * * * *